US007313241B2

(12) United States Patent
Hamacher et al.

(10) Patent No.: US 7,313,241 B2
(45) Date of Patent: Dec. 25, 2007

(54) HEARING AID DEVICE, AND OPERATING AND ADJUSTMENT METHODS THEREFOR, WITH MICROPHONE DISPOSED OUTSIDE OF THE AUDITORY CANAL

(75) Inventors: Volkmar Hamacher, Neunkirchen am Brand (DE); Torsten Niederdränk, Erlangen (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 731 days.

(21) Appl. No.: 10/692,231

(22) Filed: Oct. 23, 2003

(65) Prior Publication Data

US 2004/0136541 A1 Jul. 15, 2004

(30) Foreign Application Priority Data

Oct. 23, 2002 (DE) ..... 102 49 416

(51) Int. Cl.
*H04R 29/00* (2006.01)

(52) U.S. Cl. ..... 381/60; 381/56; 381/58; 381/92; 381/312; 381/328; 600/559

(58) Field of Classification Search ..... 381/56, 381/58, 60, 92, 1, 17, 312, 328; 600/559
See application file for complete search history.

(56) References Cited

U.S. PATENT DOCUMENTS

| | | | | |
|---|---|---|---|---|
| 6,424,721 | B1 * | 7/2002 | Hohn | 381/313 |
| 6,658,122 | B1 * | 12/2003 | Westermann et al. | 381/312 |
| 6,954,535 | B1 * | 10/2005 | Arndt et al. | 381/60 |
| 2002/0037088 | A1 * | 3/2002 | Dickel et al. | 381/317 |
| 2002/0057815 | A1 * | 5/2002 | Killion | 381/313 |
| 2002/0196947 | A1 * | 12/2002 | Lapicque | 381/17 |

FOREIGN PATENT DOCUMENTS

| | | |
|---|---|---|
| DE | 196 18 019 | 11/1997 |
| EP | 0 396 831 | 11/1994 |
| EP | 0 781 446 | 7/1997 |
| GB | 2 184 629 | 6/1987 |
| WO | WO 02/39784 | 5/2002 |

OTHER PUBLICATIONS

"Overview of the Head-Related Transfer Functions (HRTFs)," Yang, ACS4988 Audio Engineering, Pennsylvania State University (2001).
"Lokalisationsversuche für Virtuelle Realität mit einer 6-Mikrofonanordnung," Podlaszewski et al, DAGA 2001.

* cited by examiner

*Primary Examiner*—Vivian Chin
*Assistant Examiner*—Paul Disler
(74) *Attorney, Agent, or Firm*—Schiff Hardin LLP

(57) ABSTRACT

For a hearing-impaired person provided with a hearing aid device with which sound acquisition ensues outside of the auditory canals of the person, the localization capability with regard to a signal source is lost. To compensate the information loss that occurs due to the acquisition of an acoustic signal outside of the auditory canals, in the signal processing in the hearing aid device of an acoustic input signal acquired by at least one microphone of the hearing aid device, the transfer function of the head or of the external ear is taken into account between the position at which the microphone is located and a position in the auditory canal of the hearing device user. The natural location capability of a person to localize a signal source in space thus is not lost given treatment with a hearing aid device that is not worn in the auditory canal.

35 Claims, 4 Drawing Sheets

HEARING AID DEVICE, AND OPERATING AND ADJUSTMENT METHODS THEREFOR, WITH MICROPHONE DISPOSED OUTSIDE OF THE AUDITORY CANAL

BACKGROUND OF THE INVENTION

1. Field of the Invention

The invention concerns a method to adjust and a method to operate a hearing aid device wearable on the body of a test person, having a microphone system disposed outside of the auditory canals when the test person wears the hearing aid device.

The invention also concerns a hearing aid device wearable on the body of a test person, with a signal processing unit and a microphone system disposed outside when the auditory canals of the test subject wears the hearing aid device.

2. Description of the Prior Art

If a person is located in a natural sound field, sounds reach the eardrums of both ears from different directions with different levels, durations and frequency weighting. The capability of the person to localize (i.e. identify the originating location of) different signal sources in the sound field is based substantially on the existence in the horizontal plane of interaural level and duration differences. For the most part, head shadowing effects and the direction-dependent transmission characteristic of the external ears are responsible for the dependent level and duration differences of the sound incidence direction. The elevation perception (localization ability in the vertical direction) is based almost exclusively on the elevation-dependent spectral modification of the sound signal through the external ears.

For a person wearing a device having microphones disposed outside of the auditory canals, for example behind-the-ear (BTE) devices, the spectral modification via the external ears does not occur, so that important directional and elevation information is lost. The results are the known localization problems (for example forward/behind confusion) of hearing impaired persons wearing a BTE device. The interference of the spatial acoustic orientation (and with it the sound quality) connected with this often contributes to dissatisfaction with the device.

To solve this problem, in-the-ear (ITE) hearing aid devices can be used, however, with these at best small and medium hearing losses are compensated. Moreover, as a rule they are more expensive than BTE hearing aid devices and are more subject to interfering feedbacks.

In order to determine the acoustic pressure that an arbitrary signal source produces preceeding the eardrum of a person; it is sufficient to know the pulse response between the source and the eardrum. This is called HRIR (Head Related Impulse Response). Its Fourier transformations are called HRTF (Head Related Transfer Function). The HRTF comprises all physical parameters for localization of a signal source. If the HRTFs are known for the left and the right ear, binaural signals can also be synthesized from an acoustic source.

In echo-free surroundings, the HRTF is a function of four variables: the three spatial coordinates (with regard to the head) and the frequency. To determine the HRTFs, for the most part measurements are implemented on a synthetic head, for example the KEMAR (Knowles Electronics Mannequin for Acoustical Research). An overview of the determination of HRTFs is, for example, known from Yang, Wonyoung, "Overview of the Head-Related Transfer Functions (HRTFs)", ACS 498B Audio Engineering, The Pennsylvania State University, July 2001.

It is known from the field of synthetic head technology that the direction-dependent transfer functions of the head and the external ear can be relatively precisely simulated by multi-microphone arrangements in a free field with suitable subsequently circuited filters (for example Podlaszewski, Mellert: "Lokalizationsversuche für virtuelle Realität mit einer 6-Microfonanordnung", DAGA 2001). The filters are thereby designed with specific optimization methods such that the sum of the filtered microphone signals (typically 3 per side) for any spatial direction corresponds with a known error tolerance of the sound signal that was measured in the ear canal in the synthetic head in the same situation.

SUMMARY OF THE INVENTION

An object of the present invention to improve the capability for localization of a signal source of a test person provided with at least one device.

This object is achieved in accordance with the invention in a method to adjust a hearing aid device wearable on the body of a test subject, having a microphone system that is disposed (when the hearing aid device is worn) outside of the auditory canal of the test person, and having a signal processing unit, wherein the test object is exposed to an acoustic signal originating from an external signal source, and the acoustic signal transmitted to the test object is received at a location that corresponds to a location of the test subject at which the microphone system is disposed when the hearing aid device is worn. The acoustic signal transmitted to the test object is received in an auditory canal of the test object and using the received signal, a correction function is determined that, applied to the signal received outside of the auditory canal, at least approximately converts that signal into a signal that corresponds to the signal received in the auditory canal. The filter effect of a filter in the hearing aid device is adjusted so that the correction function is at least approximately implemented in a microphone signal generated by the microphone system.

The above object also is achieved in accordance with the invention in a method to operate a hearing aid device wearable on the body of a test subject, having a microphone system disposed outside of the auditory canals of the test subject when the hearing aid device is worn, and having a signal processing unit, wherein an acoustic signal originating from an external signal source is acquired by the microphone system as an acoustic input signal and is transduced into at least one electrical microphone signal, with a signal error arising in the electrical microphone signal (or an electrical signal dependent thereon) that occurs in the acquisition of the acoustic input signal outside of the auditory canal. This signal error at least partially corrected with respect to an acoustic input signal that would generate the same acoustic signal without treatment by a hearing aid device in an auditory canal of the test person, dependent on the direction of the signal source relative to the head of the test person. The corrected electrical microphone signal or the corrected electrical signal ensuing from the microphone signal is further processed and transduced into a hearing aid device output signal and supplied to the test person.

The above object also is achieved in accordance with the invention in a hearing aid device wearable on the body of a test person having a signal processing unit and a microphone system that is disposed (when the hearing aid device is worn) outside of the auditory canals of the test person, via which an acoustic input signal arising from an acoustic signal from at least one external signal source can be acquired and can be at least partially transduced into at least one electrical microphone signal. The hearing aid device has a unit that corrects a signal error, that arises in the electrical microphone signal or a signal dependent thereon due to the acquisition of the acoustic input signal outside of the auditory canals of the test person, with respect to an acoustic input signal acquired, given the same acoustic signal in an auditory canal of the test person.

The microphone system of the hearing aid device according to the invention includes at least one microphone. Preferably, the microphone system is a directional microphone system includes a number of omnidirectional microphones electrically connected with one another. Ideally, for a hearing-impaired person provided with a hearing aid device, the sound acquisition via the microphone system must ensue in the auditory canal directly before the eardrum of the person because then the signal formation of an acoustic signal would occur via the head and the external ear. In practice, however, this is possible at best only with a hearing aid device worn in the ear. In particular, given a hearing aid device worn completely in the ear, the variation is minimal with regard to an ideal microphone input signal. The more removed from the auditory canal that the sound acquisition ensues, the larger the deviation with regard to the ideal input signal. In behind-the-ear (BTE) hearing aid devices, the transfer function of the external ear is not taken into account in conventional devices in the sound acquisition via the microphone system. The error is still greater for hearing aid devices worn on the torso, for example pocket or chest devices. In these, the shadow effect of the head is not taken into account, or falsely adds to the body shadow.

The error in the acquisition of the acoustic signal originating from a signal source that exists due to the not-ideal arrangement of the microphone system outside of the auditory canal of a test person can be detected according to the invention by measurements and subsequently at least partially compensated. To measure the error, the transfer function is determined between the external signal source and the location on the body at which the microphone system of the hearing aid device is located and, given the same external conditions (emitted signal, position of the signal source with regard to the test person) the transfer function is determined between the external signal source and the auditory canal of the test person who will be provided with the device. For example, if it is intended to provide the user with a BTE hearing aid device in which the microphone system is arranged on the upper edge of the auricle, the transfer function is determined between the signal source and the auditory canal, and the transfer function also is determined between the external signal source and the location on the upper edge of the external ear at which the microphone of the BTE hearing aid device will be when worn. The transfer behavior of the external ear sought in the example can be easily determined from the respective transfer functions measured for different locations (in the example on the upper edge of the external ear and in the auditory canal), and in particular from the difference (in dB) of these transfer functions. This transfer function describes the signal formation of an acoustic signal via the external ear, which is not considered in a conventional BTE hearing aid device.

Different methods can be selected to implement the measurements. The external ear transfer function on a synthetic head, for example the KEMAR, can be determined. For this, microphones are arranged behind the ears of the synthetic head as well as in the auditory canals of the synthetic head, and the synthetic head is exposed to an acoustic signal originating from an external signal source. From the signals received by the microphones on the synthetic head for different frequencies and different positions of the signal source with regard to the synthetic head, the transfer function of the external ears thus can be determined, dependent on the signal frequency and the position of the signal source, from the differences between the signals respectively measured behind an ear and in the appertaining auditory canal. It appears that, with increasing displacement of the signal source from the synthetic head, knowledge of the precise position of the signal source is not necessary. Rather, the transfer function can be determined to a good approximation, with merely the relative direction of the signal source with regard to the synthetic head (and thus, from the view of the synthetic head, the direction of incidence of the acoustic signal) being considered. If the transfer function of the external ear is known dependent on the frequency and the direction of incidence, from this a correction function can be derived that is to be applied to the microphone signal of the microphone disposed outside of the auditory canal in order generate therefrom it the same microphone signal that was generated in the auditory canal of the appertaining ear.

The same procedure can be transferred to other carrying positions of a hearing aid device, for example in the shoulder region or on the clothing. In these cases, the relative direction of the microphone system of the hearing aid device with regard to the head is additionally considered.

In addition to measurements on a synthetic head, in the same manner measurements on one or a number of test persons can be implemented. By the selection of the test persons, a better conformity can be achieved for impaired persons who are to be provided with a hearing aid device than would be possible by measurements on a synthetic head. The best results are achieved when the measurements are implemented directly on the person to who is be provided with a hearing aid device.

A further improvement of the signal transfer behavior of a hearing aid device is achieved by implementing the measurements directly with the hearing aid device, or at least a hearing aid device identical in construction, with which the test person is to be provided. In the error correction of the microphone signal generated by the microphone system, the internal signal transfer characteristics of the microphone system, even the signal transfer behavior of the hearing aid device overall (for example the frequency paths of individual microphones of the microphone system or of the earpiece), can then be taken into consideration and at least partially corrected. By a number of measurements, the filter in the microphone signal paths of the microphone system can be optimized, such that for each direction of incidence and frequency of an input signal, the microphone signal generated by the microphone system at least approximately coincides with a microphone signal generated by a test microphone in the same surrounding situation in an auditory canal of the test person. An optimization including a number of different directions of the signal source with regard to the head of the test person, as well as for a number of different emitted acoustic signals, preferably ensues. The desired transfer function can be exactly determined for a specific measurement, characterized by the position of the signal source with regard to the head of the test person and the signal frequency of the sound signal. By a plurality of different measurements, the transfer function of the filter necessary for error correction can be optimized, dependent on the position and the frequency, using known optimization methods.

If the signal transfer function between a point at which the microphone system of a hearing aid device should be placed and a point in the auditory canal of a test person who will be provided with the hearing aid device is at least approximately known, this information can be used in different ways for signal processing in the hearing aid device. In an embodiment of the invention the microphone system of the hearing aid device have a number of microphones. For the individual measurements with regard to different output situations (different frequencies of the acoustic signal and/or different positions of the external signal source with regard to the head of the test person) adjustments for the filter arranged in the microphone signal paths can be specified that compensate the errors that arise due to the not-optimal placement of the microphones outside of the auditory canals. A microphone signal that would be generated in the same output situation by a microphone arranged in the auditory canal thus ensues from the entirety of the microphone signals generated and filtered by the individual microphones of the microphone system.

Usually, different filter functions will be derived for different output situations. Using known mathematical optimization methods, however, filter functions can be calculated without dependency on the position of the signal source with regard to the test person, and in which the thereby ensuing error (for example, averaged over all acquired output situations) is minimized. The more measurements that are available and the more microphones in the microphone system, the better the optimization result.

In another embodiment of the invention information is acquired about the alignment of the head relative to the signal source from which the acoustic signal originates during the operation of the hearing aid device. If, for example, a hearing aid device has a directional microphone system with a number of different preferred reception directions, this information can be directly acquired by the microphone system by means of a simple level comparison of the microphone signals generated by the different directional microphones. If, however, the direction of incidence of the acoustic signal with regard to the head of the test person is known, only the previous correction function determined for this direction of incidence needs to be applied to the acquired microphone signal, so that the microphone signal at least approximately coincides with a microphone signal that would ensue in the same situation via a microphone arranged in the auditory canal of the test person. It should be noted that it is not necessary to exactly localize the signal source relative to the head of the test person, but rather in practice the knowledge of the direction in which the signal source is located relative to the head is sufficient. The error that thereby occurs is negligible for displacement of the signal source from the head of more than a half meter, and therefore as a rule can be disregarded. For localization of a signal source in the horizontal plane, it is therefore only necessary to determine the angle that formed by the connection line between signal source and the head and the straight-ahead line of sight of the test person in this plane. The transfer function of a correction filter is then only dependent on a space variable, namely this direction of incidence. Should the localization of the signal source also be possible in the vertical direction, this alignment of the signal source relative to the head of the test person is also to be detected and corrected by a suitable filter function that is also dependent on this variable. The advantage of this embodiment in that the filter for correction of the signal error caused by the not-ideal position of the microphone system outside of the auditory canal can be very precisely implemented by the localization of the signal source. A disadvantage is the necessity to localize the signal source as exactly as possible and the high calculation expenditure associated with this.

In another embodiment of the invention, the microphone system has a number of directional microphones, and a filter for error correction is located in each signal path of each direction microphone. Each filter is optimized with regard to the preferred reception direction of the directional microphone in whose signal path it is arranged. The filter function of an individual filter arises from the knowledge of the signal transfer function of the acoustic signal emitted by the signal source between the position at which the directional microphone is located and a position in the auditory canal of the test person in alignment with the appertaining directional microphone, which is precisely aligned to the external signal source. This embodiment can be designed for error correction only in a horizontal plane, or in three-dimensional space. For the horizontal plane, at least two directional microphones are necessary; for three-dimensional space at least three directional microphones are necessary. The error correction is the better the more directional microphones that are used and the stronger their directional dipoles are fashioned. This static correction filter can be subsequently connected given the use of a number of directional microphones. This is adjusted once for the appertaining preferred reception direction of the associated directional microphone and then is never changed again during the operation of the hearing aid device.

If a directional microphone is fashioned from a number of omnidirectional microphones electrically connected with one another, it is thus easily possible to change the directional characteristic during the operation of the hearing aid device, and in particular the alignment of the direction dipole. In order to also allow for this situation in the error correction, a correction filter connected subsequent to a directional microphone also can be adjusted to the same degree dependent on the alignment of the direction dipole. This has the advantage that an optimal adjustment to the acoustic signal source can be made in a microphone system with few directional microphones or only one directional microphone. The correction filter connected subsequent to the directional microphone is then adjusted such that, in the hearing aid device, the transfer function of the external ear is copied for a sound signal that arrives from the direction in which the directional microphone is aligned.

The procedure described thus far for an acoustic signal source can be applied given analogously a number of acoustic signal sources. In particular, an alignment of a directional microphone or the detection of the direction of incidence of an acoustic signal can ensue for the strongest signal received by the microphone system. The error correction is then optimized, in particular for the signal source associated therewith. Furthermore, it is possible to optimize the error correction for signals with specific properties, even if such a signal is not the strongest signal acquired with the microphone system. For example, the correction can be optimized for a signal limited to a specific frequency range or a signal recognized as a speech signal.

The invention can be used in all known hearing aid device types in which the signal acquisition does not ensue directly in the auditory canal, for example in behind-the-ear hearing aid devices, hearing aid devices wearable in the concha, pocket hearing aid devices, implantable hearing aid devices or cochlear implants. Furthermore, the hearing aid device according to the invention can be part of a system that includes a number of devices to treat a hearing-impaired person, for example part of a system with two hearing aid devices worn on the head for binaural hearing assistance or part of a system having a device wearable on the head and a processor unit wearable on the head.

DESCRIPTION OF THE PREFERRED EMBODIMENTS

Figure 1:
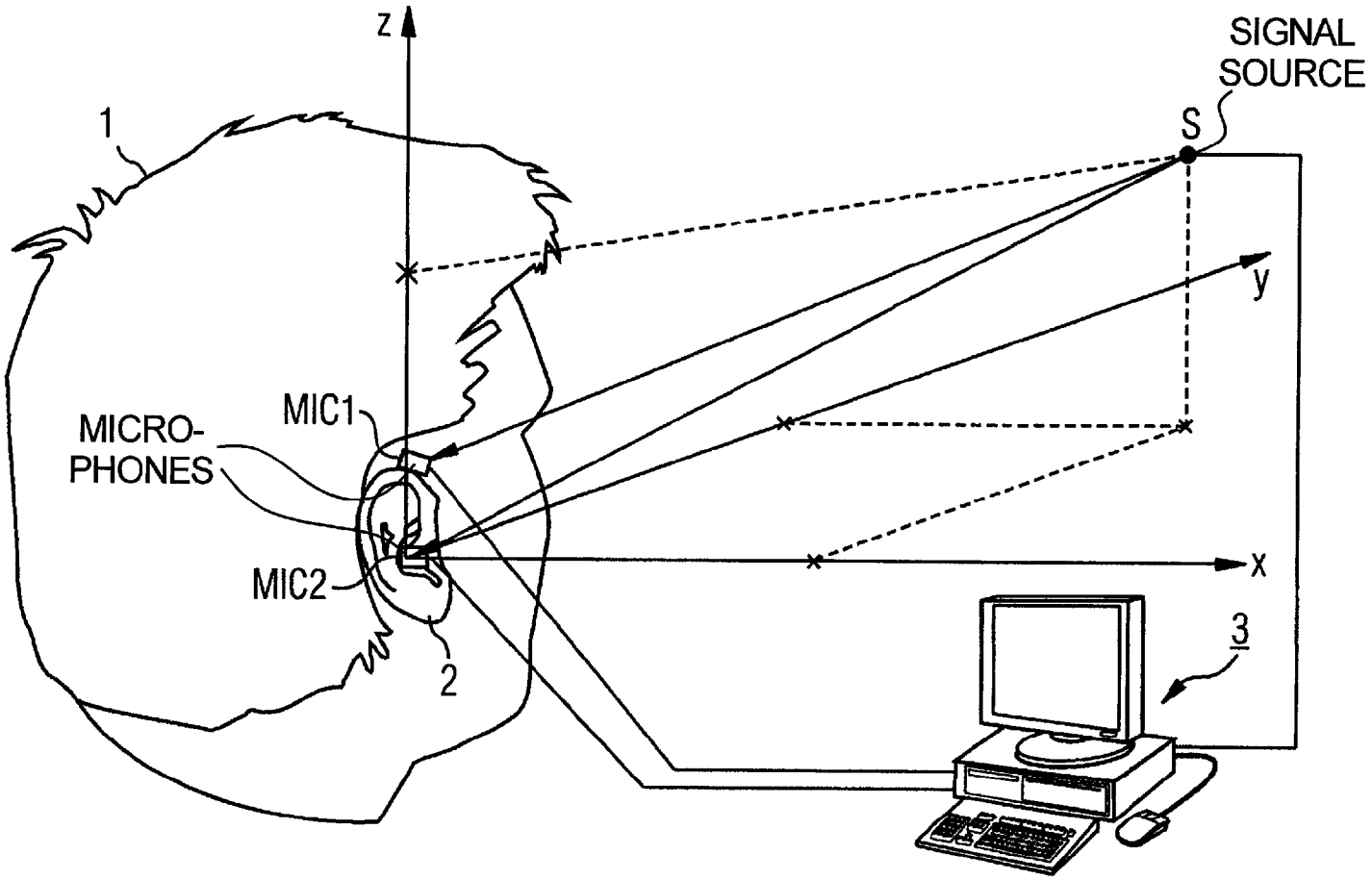
FIG. 1 shows a test person in a test environment for explaining the invention.

FIG. 1 shows a test arrangement to determine the HRTF as well as the external ear transfer function of a human ear. As used herein, "the external ear transfer function" is merely the transfer function between a point on the outer edge of the external ear and the auditory canal. For this, a test person 1 as well as a signal source S is located in a test environment. On the upper edge of the right ear 2 of the test person 1, a microphone MIC1 is arranged at a location of the ear 2 at which the microphone system for sound acquisition of an acoustic input signal sits in a behind-the-ear hearing aid device. Furthermore, a second microphone MIC2 is located in the auditory canal of the right ear 2 of the test person 1. Both the microphones MIC1 and MIC2 and the signal source S are connected with a computer system 3. The transfer function of the external ear can be determined from the difference of the acoustic input signals acquired by the microphones MIC1 and MIC2 that are caused by an acoustic signal emitted by the signal source S. Since the transfer function depends on the frequency of the emitted acoustic signal as well as the position of the signal source S relative to the head of the test person 1, a number of measurements with different frequencies and different positions is necessary in order to be able to determine the transfer function as precisely as possible. To determine the position of the signal source S relative to the head of the test person 1, a Cartesian coordinate system is used. The origin of the coordinate system is located in the exemplary embodiment at the position of the microphone MIC2 in the appertaining auditory canal of the test person 1. The straight-ahead viewing direction of the test person 1 is preferably parallel to the y-axis of the coordinate system. The x-axis is arranged at a right angle to this and, together with the y-axis, spans a horizontal plane. The z-axis points perpendicularly upward. The transfer function of the external ear in this specific microphone arrangement thus can be determined very precisely determined by a number of measurements, dependent on the frequency as well as the x-, y- and z-coordinates. It appears that the displacement of the signal source S from the head of the test person 1 plays only a subordinate role given displacements of more than one meter. Furthermore, of interest is the arrangement or projection of the signal source S in a horizontal plane that is defined by the x- and y-axes and also lies in the auditory canal of the test person 1. Then the knowledge of the angle $\phi$ shown in FIG. 2 that encompasses the signal source S with the y-axis or the straight-ahead viewing direction of the test person 1 suffices in place of the x-, y- and z-coordinates. The transfer function is then merely dependent on the frequency f of the acoustic signal and the angle $\phi$. Moreover, should the vertical alignment of the signal source S also be considered with regard to the head of the test person, the angle $\psi$, as shown in FIG. 2, is to be determined with it as a further variable.

Figure 2:
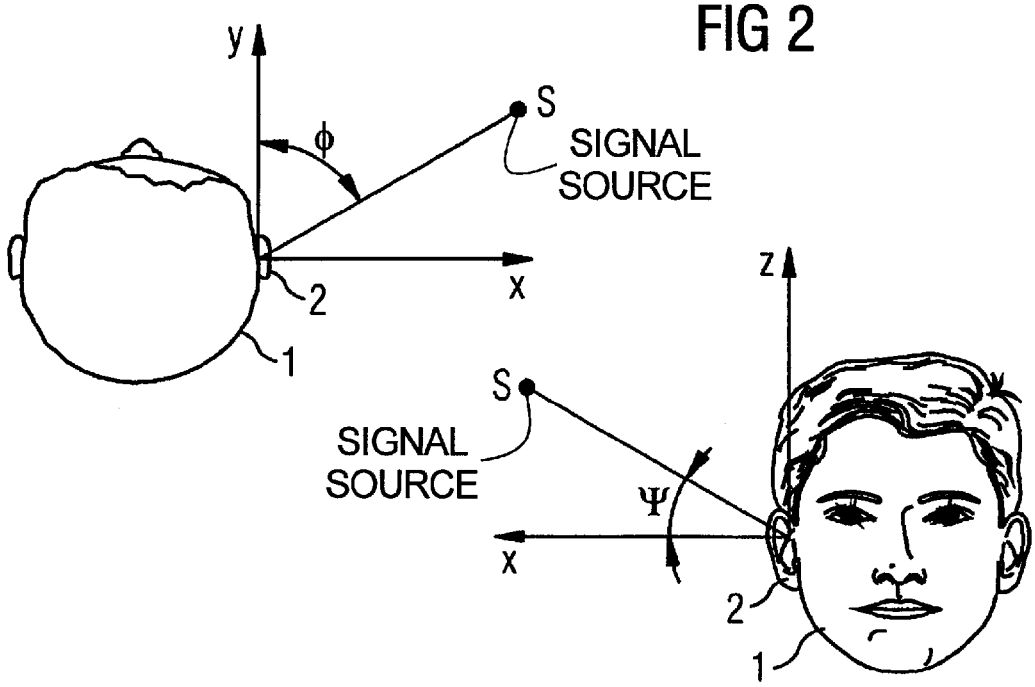
FIG. 2 shows the alignment of a signal source with regard to a head, for explaining the invention.

FIGS. 1 and 2 show only an example for the determination of the transfer function of the external ear. In a similar manner, transfer functions can be determined for other positions of the microphone MIC1, for example on a pair of glasses or in the concha. Likewise, the transfer function can be determined using a microphone MIC1 that is not arranged on the head of the test person, but rather for example a microphone arranged in the region of the shoulder or the chest.

The invention allows at least partial compensation of the errors that arise due to the not-ideal positioning of the microphone system of a hearing aid device outside of the auditory canals. For this, a correction function is to be applied to the microphone signal received by the microphone system. In a behind-the-ear hearing aid device in which the microphone is located in the position visible for the microphone MIC1 from FIG. 1, this correction function corresponds to the external ear transfer function determined according to FIG. 1 for a specific position. However, the problem exists that the respective position of a signal source with regard to the head can be determined only with effort given conventional operation of a hearing aid device. Therefore, in an embodiment of the invention the correction function implemented for error correction in the hearing aid device no longer has a variable direction dependency. The error correction thus can be optimized all the better the more microphones that the microphone system has.

Figure 3:
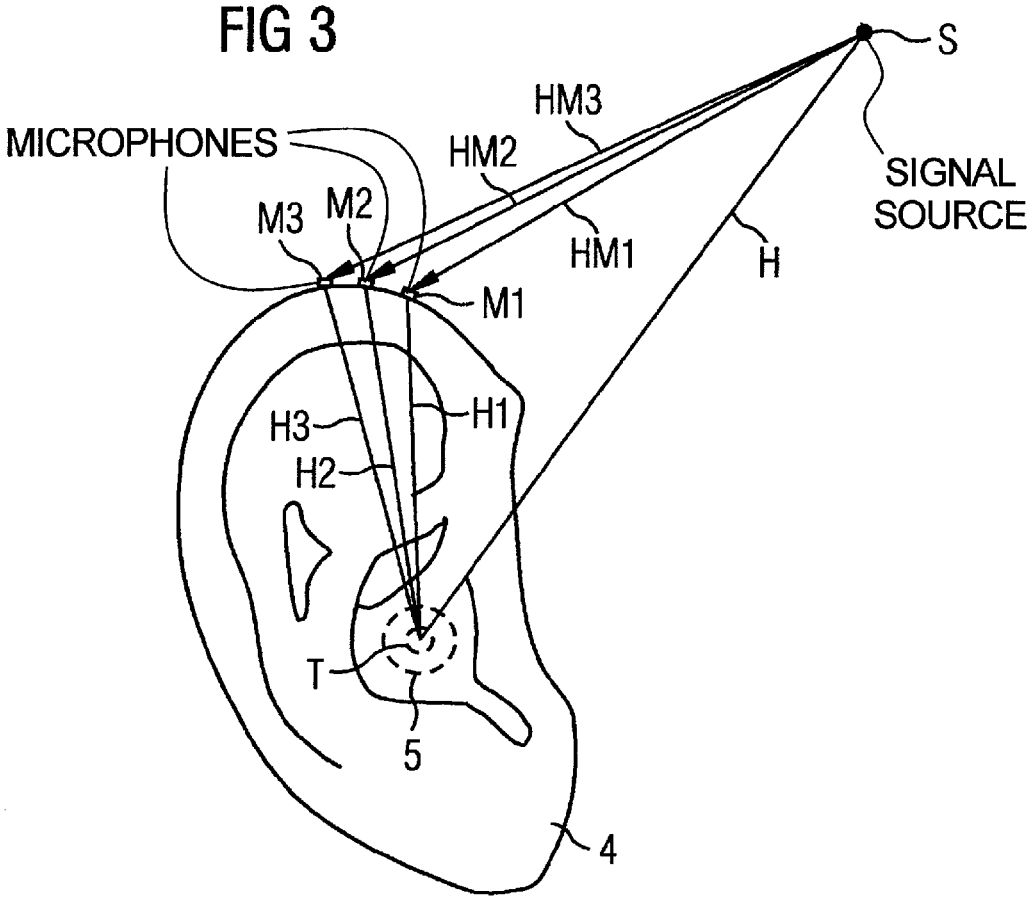
FIG. 3 shows an arrangement to determine the transfer function of the outer ear in the inventive method.

FIG. 3 schematically shows the signal transfer in the auditory canal 5 of an ear 4 of an acoustic signal originating from a point signal source S in space. The transfer function H applies for the direct path, meaning without treatment via a hearing aid device. This is dependent on the frequency of the signal source S with regard to the ear 4 and includes the signal formation via the head and the outer ear. Furthermore, the signal transfer using a hearing aid device with three microphones M1, M2 and M3 is depicted in the shown arrangement. In this case, the signal transfer function between the signal source S and the auditory canal 5 has a first signal path with a signal transfer function HM1 between the signal source S and the microphone M1, as well as the signal transfer function H1 between the microphone M1 and the auditory canal 5, a second signal path with a signal transfer function HM2 between the signal source S and the microphone M2 as well as the signal transfer function H2 between the microphone M2 and the auditory canal 5, and a third signal path with a signal transfer function HM3 between the signal source S and the microphone M3 as well as the signal transfer function H3 between the microphone M3 and the auditory canal 5. Just like the transfer function H, the transfer functions HM1, HM2, HM3 as well as H1, H2 and H3 are dependent on the frequency of the emitted signal and on the position of the signal source S with regard to the ear 4.

In the following embodiments, without limiting the generality, the distance of the signal source S from the ear 4 should be large enough that the distances of the signal source in the x-, y- and z-directions from a reference point (for example, the auditory canal entrance) do not have to be known, but rather only the direction of incidence of the acoustic signal, or the direction in which the signal source S is located relative to the reference point. Given greater displacement of the signal source S from the ear 4 (for example more than 1 meter), the error that arises can be disregarded. The dependency of the transfer functions on the position of the signal source S can then be expressed by a solid angle α. The transfer function H (f,α) from the acoustic signal source S to the auditory canal 5 (ideally a point T directly before the eardrum) coincides with the transfer function designated in the literature as an HRTF (Head Related Transfer Function), and the following relationship between a signal X (f) originating from the signal source S and a signal Z (f,α) generated in the auditory canal applies:

$$Z(f,\alpha)=H(f,\alpha)*X(f) \tag{1}$$

or $$H(f,\alpha)=\frac{Z(f,\alpha)}{X(f)} \tag{2}$$

The desired transfer function H (f,α) thus can be determined according to equation (2) using measurements of an acoustic signal in the auditory canal 5 as a reaction to an output signal emitted by the signal source S.

Given the treatment of the ear 4 of a test person via a hearing aid device with the 3 microphones M1, M2 and M3, the signal transfer function is:

$$Y(f,\alpha)=(HM1(f,\alpha)*H1(f,\alpha)+HM2(f,\alpha)*H2(f,\alpha)+HM3(f,\alpha)*H3(f,\alpha))*X(f) \tag{3}$$

If the function of the hearing aid device for comparison of a hearing loss is left unconsidered, valid for the ideal device for all f and α are:

$$Z(f,\alpha)=Y(f,\alpha) \tag{4}$$

or $$H(f,\alpha)=HM1(f,\alpha)*H1(f,\alpha)+HM2(f,\alpha)*H2(f,\alpha)+HM3(f,\alpha)*H3(f,\alpha) \tag{5}$$

Figure 4:
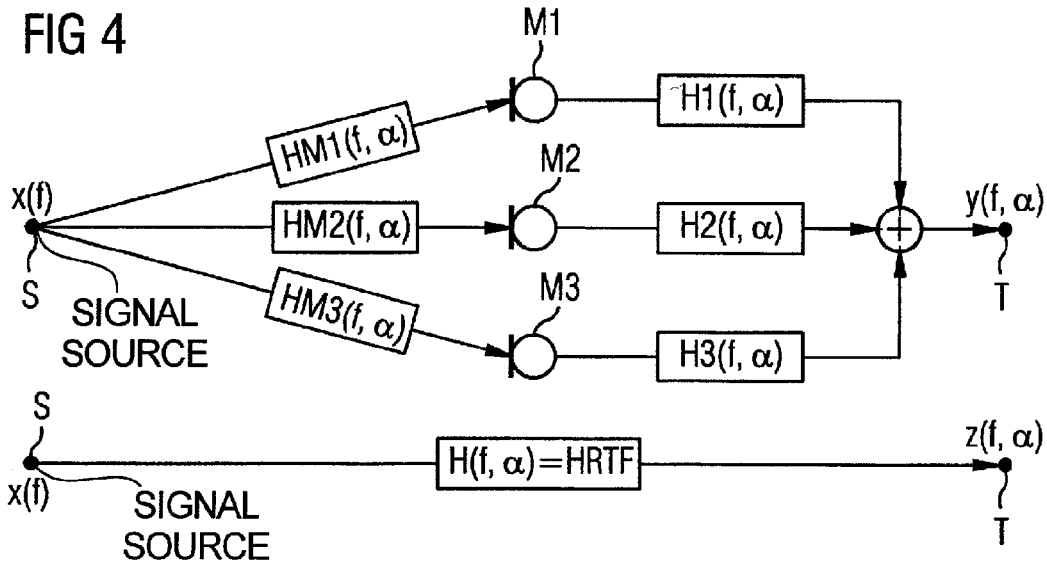
FIG. 4 is an equivalent circuit diagram for the arrangement according to FIG. 3.

FIG. 4 graphically illustrates the correlation.

The transfer function already generated via the head (however without the ear) between the signal source and the test person is plugged into the transfer functions HM1(f,α), HM2(f,α) and HM3(f,α). For error correction in the hearing aid device, it is therefore sufficient to determine the transfer functions HM1(f,α), HM2(f,α) and HM3(f,α) that together reproduce the external ear transfer function in the hearing aid device. The external ear transfer function to be reproduced can be determined, for example, according to equation (5) with a measurement arrangement according to FIG. 1 or, in an arrangement according to FIG. 3, by evaluation of the microphone signals acquired as a result of the emitted signal, by the microphone M1, M2 and M3, and a microphone signal acquired in the auditory canal. For each frequency and each angle α in common, a number of transfer functions HM1(f,α), HM2(f,α) and HM3(f,α) can be specified that fulfill the cited condition according to equation (5).

Interfering with the transfer functions HM1(f,α), HM2(f,α) and HM3(f,α) is their dependency on the solid angle α, since given normal operation of a hearing aid device these are only determined with effort. A further problem arises because, under real environmental conditions, generally multiple signal sources are simultaneously present. Therefore, the transfer functions HM1(f,α), HM2(f,α) and HM3(f,α) are optimized according to known mathematical optimization methods so that the angle dependency does not apply, and so that the errors that thereby result remain as small as possible over all considered angles. The number of the microphones used plays a deciding role in the optimization, since this determines the degrees of freedom present in the optimization. The optimization thus can be improved with additional numbers of the microphones. An optimization rule according to amount and phase for the appertaining transfer functions can be:

$$\sum_f \sum_\alpha (|H(f,\alpha)|-|HM1(f,\alpha)*H1+HM2(f,\alpha)*H2+HM3(f,\alpha)*H3|)^2=\min \tag{6}$$

$$\sum_f \sum_\alpha (\arg(H(f,\alpha))-\arg(HM1(f,\alpha)*H1+HM2(f,\alpha)*H2+HM3(f,\alpha)*H3))^2=\min \tag{7}$$

The optimization advantageously ensues over all α with 0≦α≦360°, as well as over all f in the transfer range of the hearing aid device, for example 30 Hz≦f≦10 kHz. However, only the optimization for the sub-region (partial region), for example a frequency range important for the localization capability, would also be possible.

Figure 5:
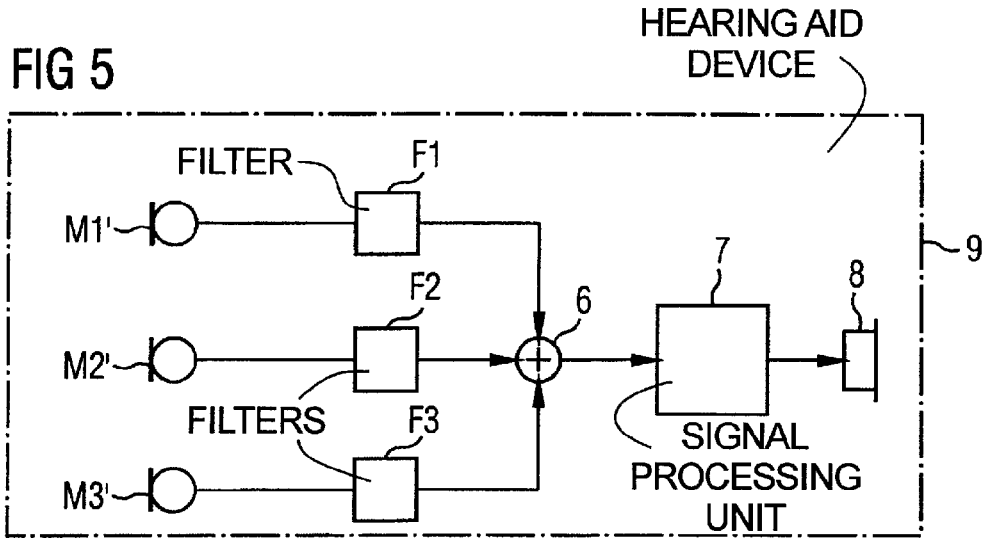
FIG. 5 is a block diagram of a hearing aid device with correction filters in the microphone signal paths in accordance with the invention.

FIG. 5 shows a hearing aid device 9 with three microphones M1', M2' and M3' in a block diagram. The microphones M1', M2' and M3' are connected subsequent to the filters F1, F2 and F3 for error correction according to the invention. If the microphones in the worn hearing aid device 9 coincide in their positions with the microphones M1, M2 and M3 of the arrangement according to FIG. 3, the filters F1, F2 and F3 can be determined and adjusted as specified above in the signal paths of the microphones for correction of the error in the microphone signal generated by the microphone system M1', M2', M3'. In the exemplary embodiment, the transfer function H1 is implemented according to the above optimization by the filter F1, the transfer function H2 is implemented according to the above optimization by the filter F2, and the transfer function H3 is implemented according to the above optimization by the filter F3. The cited signal error is thereby largely compensated and results in a signal at the output of an adder 6 that is a corrected microphone signal, that is further processed and amplified in a known manner in a signal processing unit 7 and, in the exemplary embodiment, is transduced back into an acoustic output signal and is emitted by an earphone 8.

It is to be noted that the exemplary embodiment only reproduces the principle functionality of a hearing aid device according to the invention. The individual microphones must really, not virtually, be directly connected behind filters. Likewise, the determined transfer functions can be realized in the (preferably) digital signal-processing unit 7. Reversed, the filters connected subsequent to the microphones could, in addition to the error correction, already realize further signal processing functions of the hearing aid device, and thus would not exactly implement the determined correction functions. It thus may be that the error-corrected microphone signal that is present at the output of the adder 6 appears nowhere in reality (as a measurable signal) in a real hearing aid device, but nevertheless an error correction is implemented in the sense of the invention.

Moreover, the microphone signals of a number of microphones can be supplied to a filter for error correction. Likewise, the exemplary embodiment can be expanded to more than three microphones for signal acquisition. In general, however, at least two microphones are necessary in order to be able to actually implement an optimization dependent on the direction of incidence. The optimization succeeds all the better the more microphones (and therewith degrees of freedom) that are present.

Furthermore, for adjustment of filter for error correction according to the invention, a measurement arrangement adjusted exactly as in the exemplary embodiment need not be present. For example, the adjustment of a behind-the-ear hearing aid device with 3 microphones can also form the basis of measurements with a measurement arrangement according to FIG. 1 with only one microphone MIC1 on the edge of the external ear 2 for signal detection. If the external ear transfer function is known dependent on the frequency and the angle of incidence for an external acoustic signal, filter functions can be determined from this purely through calculation, that are to be applied to the microphone signals of a hearing aid device with a number of microphones in order to reproduce the desired external ear transfer function in good approximation.

Furthermore, the invention can be expanded so that, in addition to the correction of the cited error in an analog manner, further transfer errors of the hearing aid device, for example of the earphone or the signal processing unit, are also compensated. This can ensue with a signal being generated that may not be the most ideal microphone signal that can be generated, but rather a most ideal output signal is emitted by the hearing aid device as a reaction to an input signal. For this, filters inside the hearing device are then to be adjusted such that the signal transfer errors of the hearing aid device are also entirely compensated.

Figure 6:
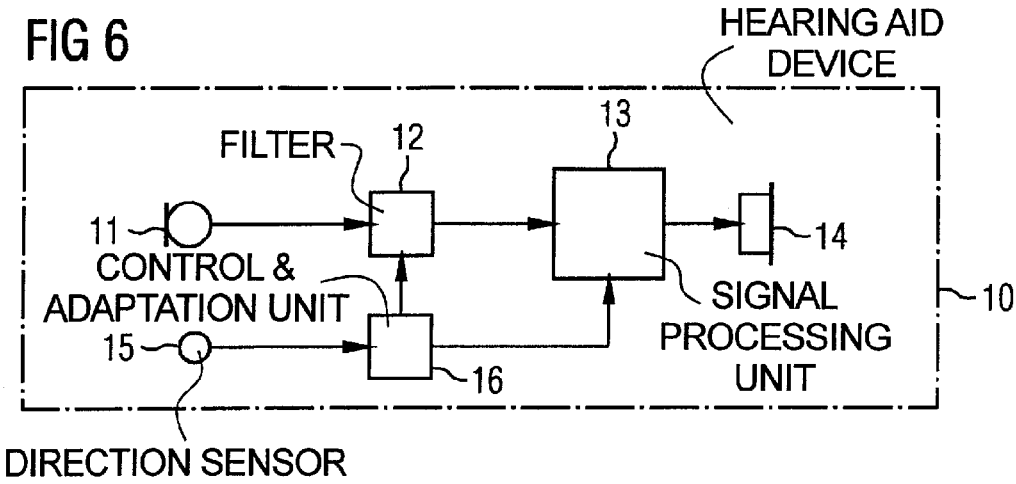
FIG. 6 is a schematic block diagram of a hearing aid device with a directional sensor in accordance with the invention.

FIG. 6 shows a further exemplary embodiment of the invention. In a hearing aid device 10 shown in a simplified block diagram with a microphone 11 arranged outside of the auditory canals of a test person, a compensation of the signal error is provided as a result of the not-optimal microphone arrangement. To compensate this error, a filter 12 is located in the signal path of the microphone 11. Furthermore, the hearing aid device 10 has a signal-processing unit 13 for further processing and amplification of the microphone signal as well as an earphone 14 to reconvert the electrical output signal into an acoustic signal. The hearing aid device 10 also has a sensor 15 with which the localization of a signal source, or the determination of the direction of the signal source relative to the head of the test person, is possible. The signal originating from the sensor 15 is supplied to an evaluation and control unit 16. Dependent on the determined direction, filter coefficients of the filter 12 are then adjusted by an evaluation and control unit 16, such that the microphone signal originating from the microphone 11 undergoes at least approximately the same transfer function as the acoustic output signal also undergoes without the provision of a hearing aid device between the position of the microphone 11 on the body of the test person and the auditory canal of the test person in which the output signal of the earphone 14 is emitted. Since, given this embodiment of the invention, the direction of incidence of an acoustic signal in the hearing aid device (and with it the alignment of the signal source relative to the head of the test person) is first determined, it offers the advantage that specifically for this input signal the external ear transfer function dependent on the angle of incidence in the hearing aid device can be very precisely reproduced.

In addition to the adaptation of filter coefficients, it is also possible for adapting to the reception direction, to connect or disconnect filters or to switch among different filters. The filters preferably are realized with digital circuit technology. Furthermore, an input signal in the filter can also undergo a signal amplification in the filter for specific frequency ranges. Furthermore, it is possible to divide the output signal of the microphone 11 into a number of frequency bands. Different filter functions for the individual frequency bands can then be adjusted to compensate the signal error in the microphone signal. Moreover, parameters of the signal-processing unit 13 can be changed dependent on the direction determined by the sensor 15. For example, it is possible that the amplification is raised in one frequency band and lowered in another frequency band, dependent on the determined direction.

In a variant of the exemplary embodiment according to FIG. 6, the microphone 11 is replaced with a number of preferred reception devices (not shown). This has the advantage that the sensor 15 can then be directly implemented via the microphone system. The direction of the signal source relative to the microphone system can then be determined by a comparison of the microphone signals in the different preferred reception devices. The independent sensor 15 can thus be dispensed with.

Figure 7:
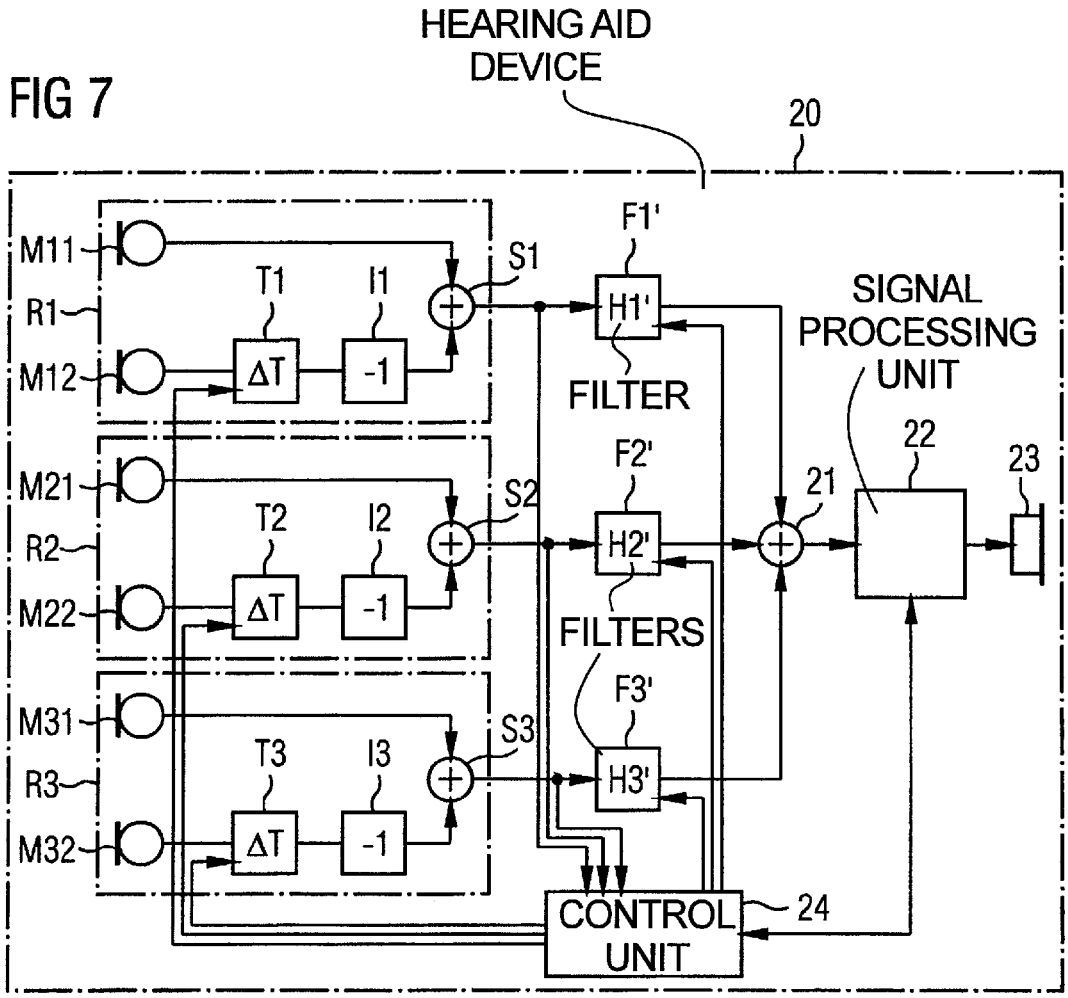
FIG. 7 is a schematic block diagram of a hearing aid device with a number of directional microphones in accordance with the invention.

FIG. 7 shows a further embodiment of the invention. The hearing aid device 20 has the three directional microphones R1, R2 and R3. These are respectively realized by the electrical connection of two omnidirectional microphones M11, M12; M21, M22; M31, M32, with delay element T1, T2 or T3 as well as an inverter I1, I2 or I3 being located in one microphone path of each directional microphone R1, R2 or R3, and both microphone signal pairs M11, M12; M21, M22; M31, M32 of the respective directional microphones R1, R2 or R3 are subsequently added into the summation points S1, S2 or S3. The directional microphones R1, R2, R3 have different preferred direction devices. Filters F1', F2' and F3' that realize the signal transfer functions H1', H2' and, respectively H3' are connected subsequent to the microphones. The microphone signals of the directional microphones R1, R2, R3 are subsequently merged into the summation point 21. The signal processing then ensues in a known manner in a signal-processing unit 22, and the reconversion of the processed microphone signals into an acoustic output signal thereupon ensues in an earphone 23.

The filters F1'-F3' effect a compensation of the signal error in the microphone signals that exists due to the not-ideal acquisition of an acoustic input signal by the microphones M11, M12; M21, M22; M31, M32 outside of the auditory canals of a test person. Different from the exemplary embodiment according to FIG. 6, in the exemplary embodiment according to FIG. 7 no localization of a signal source from which an acoustic output signal originates ensues, i.e. there is no determination of the direction of the signal source from the microphone system. Rather, the filters F1'-F3' are adapted to the directional microphones R1-R3 in whose signal paths they are located. The transfer function H1' of the filter F1' preferably coincides at least approximately with the transfer function that is necessary for correction of the microphone signal generated by the microphone R1, such that the corrected microphone signal corresponds to a microphone signal that would be acquired by a microphone arranged in the auditory canal of the ear provided with the hearing aid device 20, and specifically for an auditory situation in which the directional microphone is aligned to the signal source. Likewise, the transfer functions H2' and H3' of the filters F2' and F3 are also preset for the auditory situations for which the signal source is located in the respective preferred reception directions of the appertaining directional microphone. Given exposure of the hearing aid device 20 to acoustic energy from a specific direction, the directional microphone that will supply the strongest microphone signal is the one with a preferred reception direction traversed by the incoming signal earliest, so a good approximation to the ideal microphone signal results overall via the shown arrangement.

It should be noted that FIG. 7 only schematically illustrates an embodiment of the invention with a number of directional microphones. Thus in the practical realization, for example, two omnidirectional microphones are sufficient whose output signals are respectively processed in parallel (delayed and added in a number of parallel microphone signal paths of a microphone) in order to generate a number of directional microphones with different preferred reception directions.

In a version of the exemplary embodiment according to FIG. 7 that the preferred reception directions of the directional microphones R1-R3 can be changed. The adjustment of the preferred reception direction can ensue, for example, in the adaptation of the hearing aid device 20 to a test person or during the operation of the hearing aid device 20, for example by a program change. The transfer functions H1'-H3' of the filters F1'-F3' are also then correspondingly adapted given a change of the preferred reception direction in at least one the of the directional microphones R1-R3. The hearing aid device 20 provides for this an adaptation and control unit 24 that is connected with the signal processing unit 22 as well as the delay elements T1-T3 and the filters F1'-F3'. If a change of the preferred reception direction in at least one of the directional microphones R1-R3 ensues due to a parameter change in the signal processing unit 22 set by the control and adaptation unit 24 by changing the signal delay The transfer functions H1'-H3' of the filters F1'-F3' are also thus adapted to the new preferred reception directions by the control and adaptation unit 24.

The hearing aid device 20 according to FIG. 7 also can be operated in a manner that corresponds to the operating manner of the hearing aid device 10 according to FIG. 6. The directional microphones R1-R3 then form the direction sensor with which the alignment of a signal source can be determined relative to the head of a test person. For direction determination, the microphone signals of the directional microphones R1-R3 are supplied to the control and adaptation unit 24 that in particular determines the alignment from a level comparison of the individual directional microphone signals and adjusts the filters F1'-F3' corresponding to the determined alignment.

Figure 8:
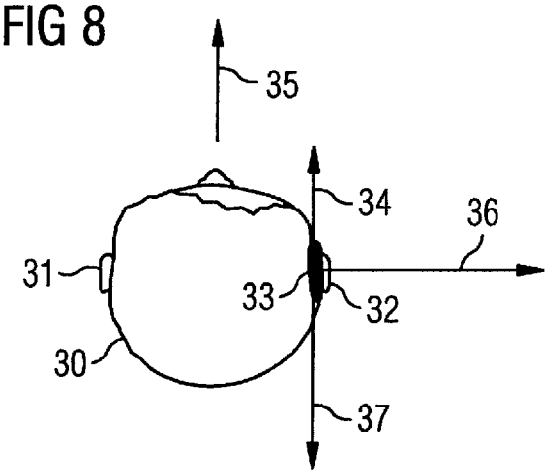
FIG. 8 illustrates an example for alignment of the directional microphones of the hearing aid device according to FIG. 7.

FIG. 8 shows a preferred adjustment of the preferred reception direction of three microphones in the treatment of a test person. FIG. 8 is a plan view of the head 30 of the test person with a left ear 31 and a right ear 32 behind which a hearing aid device 33 is arranged. The preferred reception direction 34 of a first directional microphone thereby coincides with the straight-ahead viewing direction of the test person. The preferred reception direction of a second directional microphone points in the opposite direction 37, and the preferred reception direction 36 of a third directional microphone is at a right angle to the aforementioned preferred reception directions. All of the aforementioned directions preferably lie in a plane. Furthermore, it is possible for the preferred reception directions of further directional microphones (not shown) to lie outside of this plane. A test person with a hearing aid device according to FIG. 7 and the adjustment of the directional microphones according to FIG. 8 thus can well localize a signal source in the plane. With the expanded arrangement in which directional microphones are also provided with vertical alignment (not shown), even the possibility of localization in three-dimensional space is achieved.

In summary, for a hearing-impaired person who is provided with a hearing aid device, in order to improve the capability for localization of a signal source in space, static filters are included in the microphone signal paths of the hearing aid device. The filters are designed with a suitable method such that the sum signal of the filtered microphone signals for sound incidence from arbitrary spatial directions with an acceptable error tolerance corresponds to the signal that would be measured in the same sound situation given natural hearing in an open ear canal. In this manner, the directional contribution of the head and of the outer ear necessary for localization is electrically added via the filters. In BTE devices whose microphone signals already include head shadow effects due to the head-proximate arrangement, the filters substantially reproduce the transfer properties of the external ear. Microphones positioned at arbitrary locations (for example shoulder, clothes and so forth) are also compensatable. The filters then include the HRTFs and the inverted transfer functions for respective positions of the microphones.

Alternatively, a running localization of the sound source (s) can ensue with suitable localization methods that are preferably based on the sound analysis with multi-microphone arrangements (unilateral, bilateral). The HRTFs belonging to the current direction of sound incidence can then always be reproduced "online", and the spectral modification of a sound signal acquired by the can be adaptively implemented.

Although modifications and changes may be suggested by those skilled in the art, it is the intention of the inventor to embody within the patent warranted hereon all changes and modifications as reasonably and properly come within the scope of his contribution to the art.

We claim as our invention:

1. A method for adjusting a hearing aid device configured to be worn at the body of a person, said hearing aid device having a microphone system that, when said hearing-aid device is worn, is disposed outside of the auditory canals of the person, and having a signal processor connected to a filter arrangement, and to said microphone system, comprising the steps of:

subjecting a test object to an acoustic signal originating from an external signal source remote from the test object;

receiving the acoustic signal at the test object at a location on the test object corresponding to a location on the person at which the microphone system is disposed when the hearing aid device is worn by the person, thereby obtaining a first received signal;

also receiving said acoustic signal at an auditory canal of the test object, thereby obtaining a second received signal;

determining a correction function from said first and second received signals that, when applied to said first received signal, at least approximately converts said first received signal into said second received signal; and adjusting said filter arrangement in said signal processor to apply said correction function to said microphone signal before processing in said signal processor, to produce an adiusted hearing aid device that, despite the microphone system, when worn, being outside of the auditory canals of the person, simulates an acoustic signal received in the auditory canals.

2. A method as claimed in claim 1 comprising employing a synthetic head as said test object.

3. A method as claimed in claim 1, comprising employing a person as said test object.

4. A method as claimed in claim 1, comprising employing a person who will wear said hearing-aid device as said test object.

5. A method as claimed in claim 1, comprising subjecting said test object to respective acoustic signals from said signal source at different alignments of said signal source relative to said test object, and determining said correction function for each of said different alignments.

6. A method as claimed in claim 5, comprising employing, as said microphone system, a system having at least two microphones.

7. A method as claimed in claim 6, comprising forming said microphone system from a plurality of directional microphones respectively having different preferred reception directions, and forming each of said directional microphones by electrically connecting at least two omni-directional microphones.

8. A method as claimed in claim 6, wherein each of said at least two microphones has an electrical signal path associated therewith, and comprising forming said filter arrangement from a plurality of filters respectively electrically connected in said signal paths.

9. A method as claimed in claim 8, wherein each of said filters has a filter function, and adjusting the respective filter functions so that said filter functions, in combination, implement said correction function dependent on said different alignments of said signal source relative to said test object.

10. A method as claimed in claim 1, comprising employing, as said microphone system, a system having at least two directional microphones having respectively different preferred reception directions, and determining said correction function for each of a plurality of different alignments of said signal source relative to said test object, identifying one of said directional microphones having a preferred reception direction proceeding in a direction toward said signal source, and implementing said correction function by adjusting a filter function of a filter electrically connected following said one of said directional microphones.

11. A method for operating a hearing aid device configured to be worn on the body of a user, said hearing aid device having a microphone system that, when worn by the user, is disposed outside of the auditory canals of the user, and having a signal processing unit, said method comprising the steps of:

receiving, with said microphone system, an acoustic signal originating from a signal source remote from the microphone system as an acoustic input signal, and in said microphone system, transducing said acoustic input signal into an electrical microphone signal, said electrical microphone signal containing a signal error arising due to said microphone system being disposed outside of the auditory canals of the user;

at least partially correcting said signal error with respect to an acoustic input signal that said acoustic signal would generate in an auditory canal of said user dependent on a direction of said signal source relative to the head of the user, thereby generating a corrected signal selected from the group consisting of a corrected microphone signal and a corrected electrical signal ensuing from said microphone signal; and processing said corrected signal in said signal processing unit to obtain a processed signal, and transducing the processed signal to produce an output acoustic signal, and supplying said output acoustic signal to said user, to produce an adjusted hearing aid device that, despite the microphone system, when worn, being outside of the auditory canals of the person, simulates an acoustic signal received in the auditory canals.

12. A method as claimed in claim 11, wherein said hearing-aid device comprises a signal path containing a filter, and comprising correcting said error signal by adjusting a filter function of said filter.

13. A method as claimed in claim 12, wherein said microphone system comprises at least two microphones, and connecting said filter in said filter path following said at least two microphones.

14. A method as claimed in claim 12, wherein said hearing-aid device is adapted to be worn on the head of the user, and comprising correcting said error signal by adjusting said filter function dependent on a relative alignment between said microphone system and the head of the user.

15. A method as claimed in claim 14, comprising identifying an at least approximate direction of a location of said signal source relative to the head of the user, and correcting said signal error by adjusting said filter function dependent on said direction.

16. A method as claimed in claim 15, comprising identifying said direction using said microphone system.

17. A method as claimed in claim 16, comprising generating a plurality of acoustic signals respectively from a plurality of signal sources remote from said microphone system and, using said microphone system, determining a direction of a location of the signal source that produced one of said input signals having predetermined properties.

18. A method as claimed in claim 15, comprising identifying said direction as a projection of the signal source in a horizontal plane in which the head of the user is disposed.

19. A method as claimed in claim 15, comprising identifying said direction at least approximately in three-dimensions.

20. A method as claimed in claim 11, comprising employing, as said microphone system, a system comprising at least two directional microphones with respectively different preferred reception directions, connecting a filter arrangement in a signal path subsequent to the directional microphones, and correcting said error signal by optimizing a filter function of said filter arrangement for at least one of said preferred reception directions.

21. A method as claimed in claim 20, comprising employing said at least two directional microphones with respective preferred reception directions that at least approximately define a horizontal plane.

22. A method as claimed in claim 21, comprising employing, as said microphone system, a system comprising at least three directional microphones with a third of said at least three directional microphones having a preferred reception direction proceeding at least approximately in a vertical direction.

23. A method as claimed in claim 20, comprising employing, as one of said at least two directional microphones, a directional microphone having an adjustable preferred reception direction, and adapting said filter function dependent on adjustment of said preferred reception direction of said third of said at least three microphones.

24. A hearing aid device configured to be worn on the body of a user, comprising:

a microphone system that is disposed outside of the auditory canals of the user when the hearing aid device is worn by the user, said microphone system transducing an acoustic input signal, detected from a signal source remote from the microphone system, into an electrical microphone signal, said electrical microphone signal containing a signal error due to the microphone system being disposed outside of the auditory canals of the user;

a signal error correction arrangement supplied with an error-containing signal that contains said signal error, selected from the group consisting of said electrical microphone signal and signals ensuing from said electrical microphone signal, that corrects said signal error in said error-containing signal with respect to an acoustic signal, that is the same as said acoustic input signal detected by said microphone system, acquired in an auditory canal of the user to produce a corrected electrical microphone signal;

a signal processor supplied with said corrected signal for processing said corrected electrical microphone signal to produce an electrical processed signal that, when transduced into an audio signal, simulates an acoustic input signal received at the auditory canals of the user despite the microphone system being disposed outside of the auditory canals of the user; and an electro-acoustic transducer supplied with said processed signal that transduces said processed signal into said audio signal.

25. A hearing aid device as claimed in claim 24, wherein said signal error correction arrangement comprises at least one filter with a filter function that is adapted to correct said signal error.

26. A hearing aid device as claimed in claim 25, wherein said microphone system comprises at least two microphones and wherein said signal error correction arrangement comprises filters respectively connected to said at least two microphones, each having a filter function that is adapted to correct said signal error.

27. A hearing aid device as claimed in claim 26, wherein said at least two microphones comprise at least two directional microphones having respectively different preferred reception directions.

28. A hearing aid device as claimed in claim 27, wherein each of said directional microphones is comprised by a plurality of omni-directional microphones electrically connected to each other.

29. A hearing aid device as claimed in claim 27, wherein the respective preferred reception directions of said at least two directional microphones at least approximately define a horizontal plane.

30. A hearing aid device as claimed in claim 27, wherein at least one of said directional microphones has a preferred reception direction in a vertical direction.

31. A hearing aid device as claimed in claim 25, comprising a detector for detecting a direction at which said signal source is located relative to the head of the user, and wherein said filter arrangement is adaptable dependent on said direction.

32. A hearing aid device as claimed in claim 31, wherein said microphone system comprises a plurality of directional microphones, and wherein said detector comprises said microphone system.

33. A hearing aid device as claimed in claim 32, wherein said filter arrangement is connected subsequent to at least one of said directional microphones.

34. A hearing aid device as claimed in claim 33, wherein said filter is adapted by optimizing said filter function with regard to the preferred reception direction of said at least one directional microphone.

35. A hearing aid device as claimed in claim 33, wherein the preferred reception direction of said at least one directional microphone is adjustable, and wherein said filter function of said filter is adaptable to adjustment of said preferred reception direction of said at least one of said directional microphones.

* * * * *